US005666668A

United States Patent [19]

Ronquillo

[11] Patent Number: 5,666,668

[45] Date of Patent: Sep. 16, 1997

[54] CAP WITH FRONT SIZE ADJUSTMENT AND REAR FLAP

[76] Inventor: Chad N. Ronquillo, 11801 Black Forest La. SE., Olalla, Wash. 98359

[21] Appl. No.: 434,774

[22] Filed: May 4, 1995

[51] Int. Cl.[6] ..... A42B 1/06

[52] U.S. Cl. ..... 2/172; 2/171; 2/183; 2/209; 2/209.13

[58] Field of Search ..... 2/171, 173, 172, 2/175.6, 175.7, 181, 181.2, 181.4, 183, 195.2, 206, 207, 209, 209.13, 423, 424

[56] References Cited

U.S. PATENT DOCUMENTS

| | | | |
|---|---|---|---|
| D. 83,403 | 2/1931 | Kirschner . | |
| D. 337,645 | 7/1993 | Guziejka | D2/884 |
| 357,418 | 2/1887 | Seldner . | |
| 1,909,686 | 5/1933 | Kindall | 2/207 |
| 2,561,857 | 7/1951 | Goldman | 2/172 |
| 2,611,902 | 12/1952 | Rockmore . | |
| 3,512,181 | 5/1970 | Osborne . | |
| 4,131,953 | 1/1979 | Kimotsuki . | |
| 5,025,505 | 6/1991 | Fekete | 2/195.2 |
| 5,035,004 | 7/1991 | Koester | 2/173 |
| 5,070,545 | 12/1991 | Tapia . | |
| 5,099,524 | 3/1992 | Linday . | |
| 5,177,812 | 1/1993 | DeMars . | |
| 5,253,364 | 10/1993 | Robinson . | |
| 5,473,778 | 12/1995 | Bell | 2/209.13 |
| 5,493,735 | 2/1996 | Rice | 2/209.13 |

FOREIGN PATENT DOCUMENTS

| | | | |
|---|---|---|---|
| 53602 | 5/1912 | Austria . | |
| 1079622 | 12/1954 | France | 2/172 |

*Primary Examiner*—Diana Biefeld
*Attorney, Agent, or Firm*—Richard C. Litman

[57] ABSTRACT

A baseball-style cap unencumbered by a bill or visor. A brimless baseball-style cap has the advantages of being lightweight, requires less structure and therefore less material, is inexpensive and provides opportunities for unique attachments. The baseball-style cap of the instant invention replaces the bill or visor with a decorative cloth and/or chin strap with ear cushions. Since many people wear baseball caps backwards or in reverse, the decorative cloth which will hang down behind the head and neck will provide an opportunity for the wearers to display their favorite logo or design in a unique and exciting way.

6 Claims, 6 Drawing Sheets

CAP WITH FRONT SIZE ADJUSTMENT AND REAR FLAP

BACKGROUND OF THE INVENTION

1. Field of the Invention

The present invention relates to a brimless or visorless baseball-style cap. The adjustable cap incorporates a chin strap and ear cushions along with a cloth having logos or other type designs affixed thereto.

2. Description of the Prior Art

It has become increasingly popular to wear baseball-style caps backwards wherein the visor is orientated in a reverse direction. In fact, many wearers would rather wear their caps backwards. With the cap worn in this configuration the usefulness of the visor is greatly diminished. A more efficient use of materials would be to replace the bill with a cloth like material that can display logos or captivating designs that would be attractive to sports fans and other consumers.

Many cap wearers lose their caps in strong winds or while participating in activities such as amusement park rides. A detachable chin strap for use with a baseball style cap would prevent the possibility of losing the cap in the wind.

There is therefore a need for a cap that is unencumbered by the structure of a bill or visor, has a cloth attached in lieu of the bill that showcases logos or designs, is adjustable to fit many sizes and incorporates a removable chin strap to secure the cap. The present invention provides such a device.

Visorless caps have been described in the patent literature. For instance, U.S. Pat. No. 5,253,364, issued Oct. 19, 1993, to Robinson, describes a baseball-style cap having a rotatable bill. The Robinson patent teaches attaching the bill at various positions along the cap. The Robinson patent is devoid of any teaching of wearing the cap without the bill or of attaching a chin strap or logo bearing cloth. Likewise, U.S. Pat. No. 5,070,545, issued Dec. 10, 1991, to Tapia and U.S. Pat. No. 5,099,524, issued Mar. 31, 1992, to Linday both lack any teaching of wearing the cap without the visor along with attaching a chin strap or logo bearing cloth.

U.S. Pat. No. 4,131,953, issued Jan. 2, 1979, to Kimotsuki, U.S. Pat. No. 357,418, issued Feb. 8, 1887, to Seldner, U.S. Pat. No. 2,611,902, issued Sep. 30, 1952, to Rockmore, U.S. Pat. No. 5,177,812, issued Jan. 12, 1993, to DeMars, U.S. Pat. No. 3,512,181, issued May 19, 1970, to Osborne, U.S. Design Pat. No. 83,403, issued Sep. 27, 1930 and Austrian Pat. No. 53,602, issued May 25, 1912 all show visorless caps but lack any teaching of combining the visorless caps with a chin strap or logo bearing cloth.

None of the above inventions and patents, taken either singly or in combination, is seen to describe the instant invention as claimed.

SUMMARY OF THE INVENTION

The present invention relates to an adjustable brimless baseball-style cap having a cloth attached thereto, wherein the cloth contains either a logo or design. The cap is designed and configured to be worn backwards with the adjusting means facing forward. In this configuration, the cloth would hang down covering the neck of the wearer. The logo or design affixed to the cloth can be easily seen by persons near the wearer.

In addition to the decorative or logo bearing cloth, the cap incorporates a detachable chin strap. The chin strap is attached to the cap through various means such as a snap fit or a VELCRO® type fastener. Attached to the chin strap are ear cushions that protect and add comfort to the ear. The two members of the chin strap are attached together through any appropriate means including but not limited to snap fits or VELCRO® type hook and loop fasteners.

The cap is adjustable to fit various head sizes through means that allow for the cap to be tightened or loosened based on the wearer's head size.

Accordingly, it is a principal object of the invention to provide an adjustable baseball-style cap that is unencumbered with a brim or visor.

It is another object of the invention to provide an adjustable brimless cap having a cloth that hangs down covering the neck of the wearer.

It is a further object of the invention to provide a brimless cap having a cloth wherein the cloth contains either a logo or decorative design.

Still another object of the invention is to provide a brimless cap having a detachable chin strap.

An additional object of the invention is to provide an ear cushion attached to the chin strap.

It is again an object of the invention to provide a brimless cap having a detachable chin strap wherein the chin strap is attached to the cap through any appropriate means.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
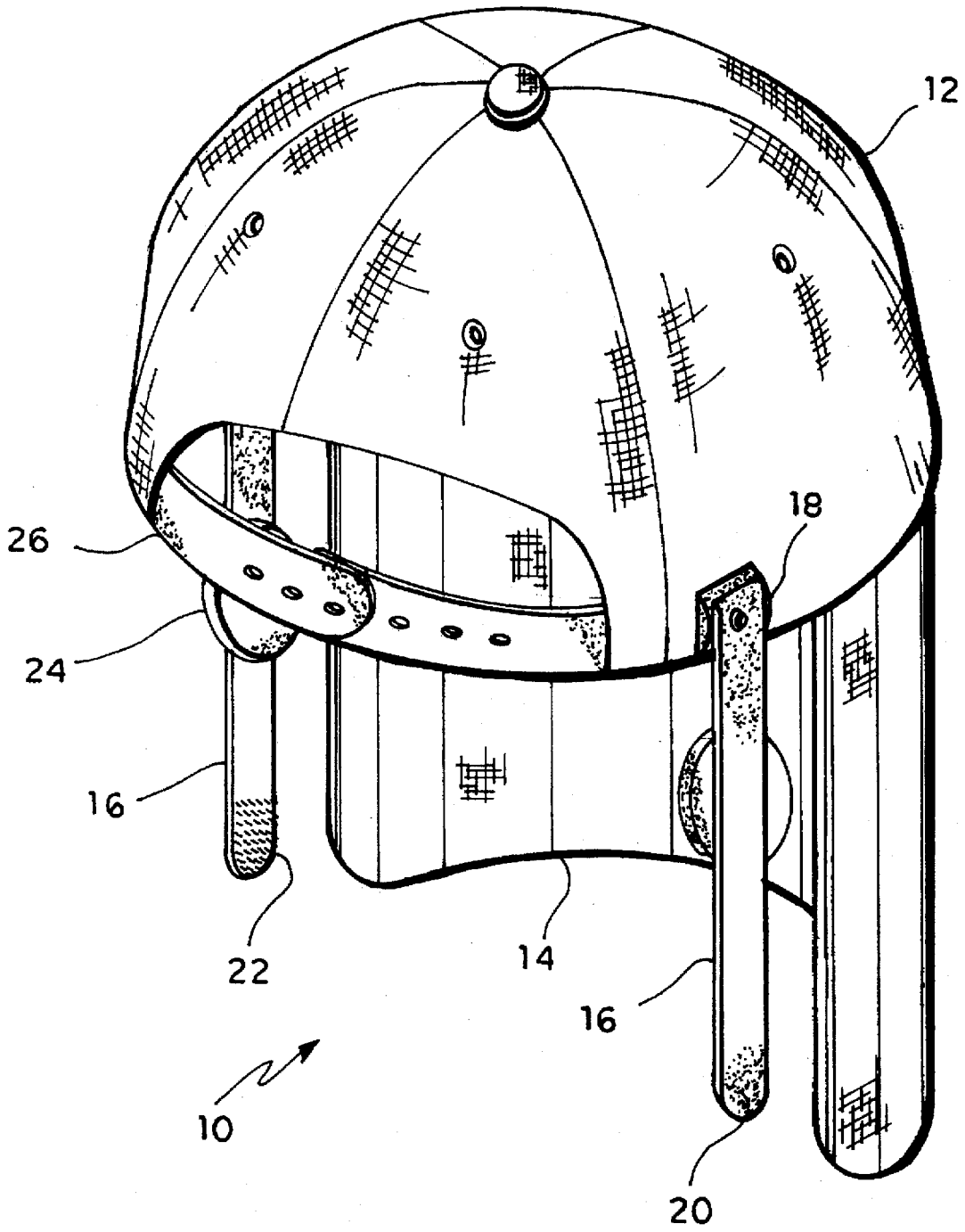
FIG. 1 is a front perspective view of the preferred embodiment.

Turning now to FIG. 1 of the drawings, the brimless baseball-style cap 10 is shown with the crown 12 having size adjustment means 26. The crown 12 has attached thereto a chin strap 16 that is detachable through attachment means 18. The attachment means 18 are of a snap fit type design but could, be a VELCRO® or appropriate type hook and loop fastener. The chin strap 16 has attached thereto ear cushions 24. The ear cushions 24 are designed and configured in such a way as to protect and provide comfort for the wearer's ears. The chin strap 16 has fastening means 20, 22. The fastening means 20, 22 are of a VELCRO® type hook and loop design but could be made of any appropriate configuration.

The cloth 14 is attached to the crown 12 and will hang down approximately 7 to 12 inches. The cloth 14 is attached at approximately the same location as the brim would normally be attached. The cloth 14 and brimless design reduces the need for the support structure and stitching required to support a bill or visor. The cap 10 is worn with the cloth 14 at the rear of the cap 10. In this configuration, the front part of the cap 10 is defined by the adjustment means 26 which normally would be considered the rear part of a base-ball style cap.

Figure 2:
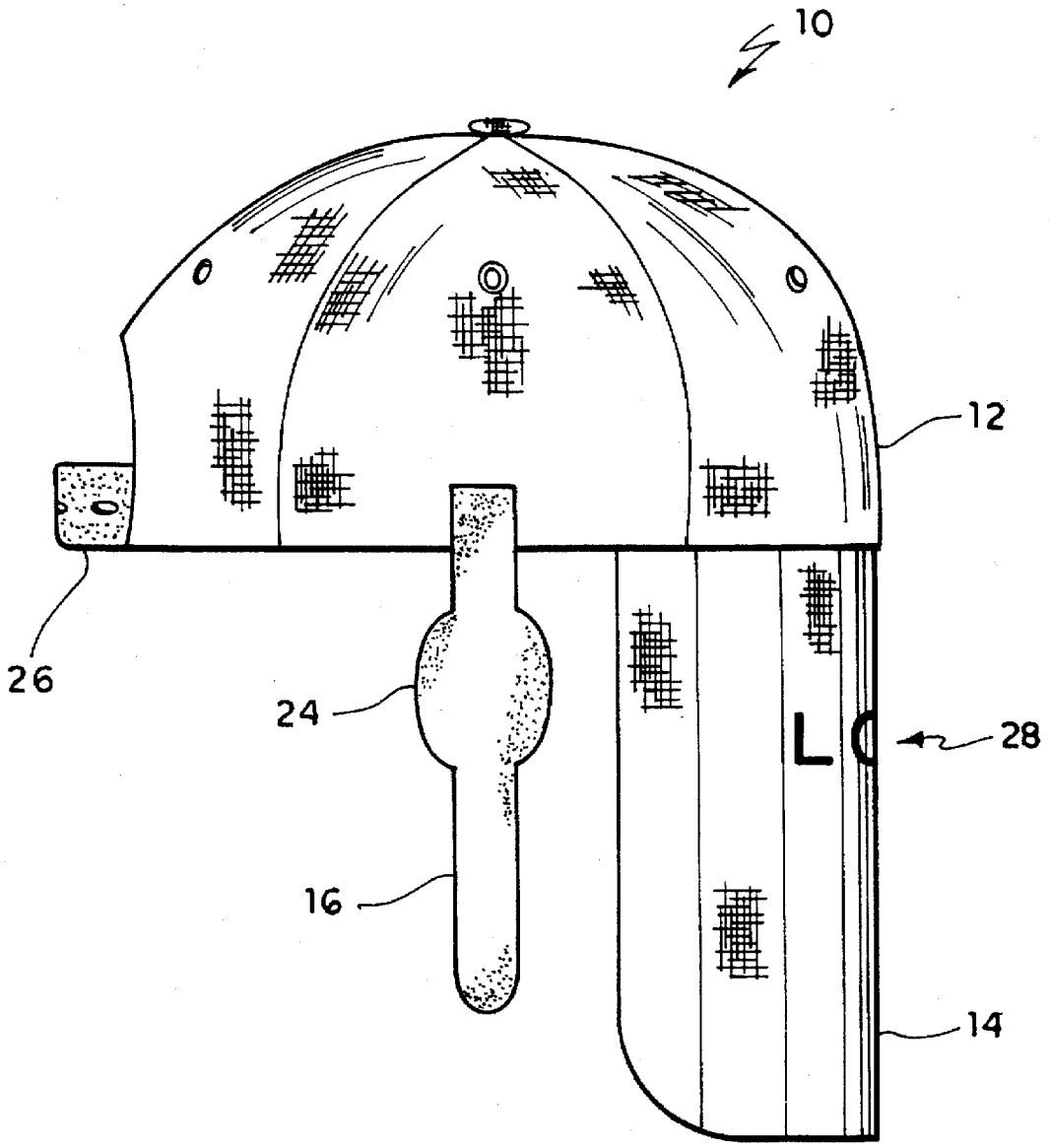
FIG. 2 is a right side elevational view of the preferred embodiment.
Figure 3:
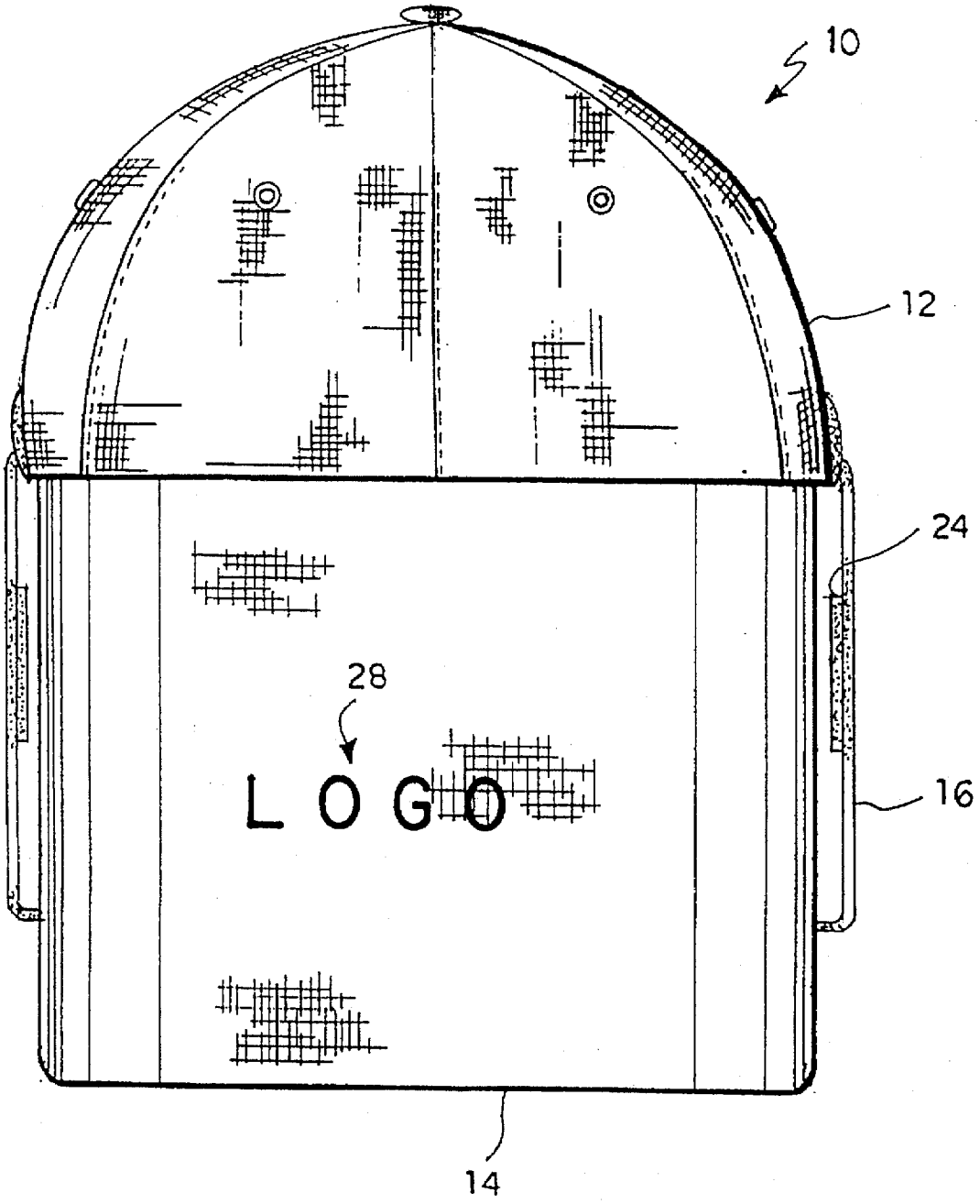
FIG. 3 is a rear elevational view of the preferred embodiment.

Turning now to FIGS. 2 and 3 of the drawings, the cap 10 is shown with the cloth 14 having a logo 28 affixed thereto. The cloth 14 can display a logo 28 or any type of design or decoration.

Figure 4:
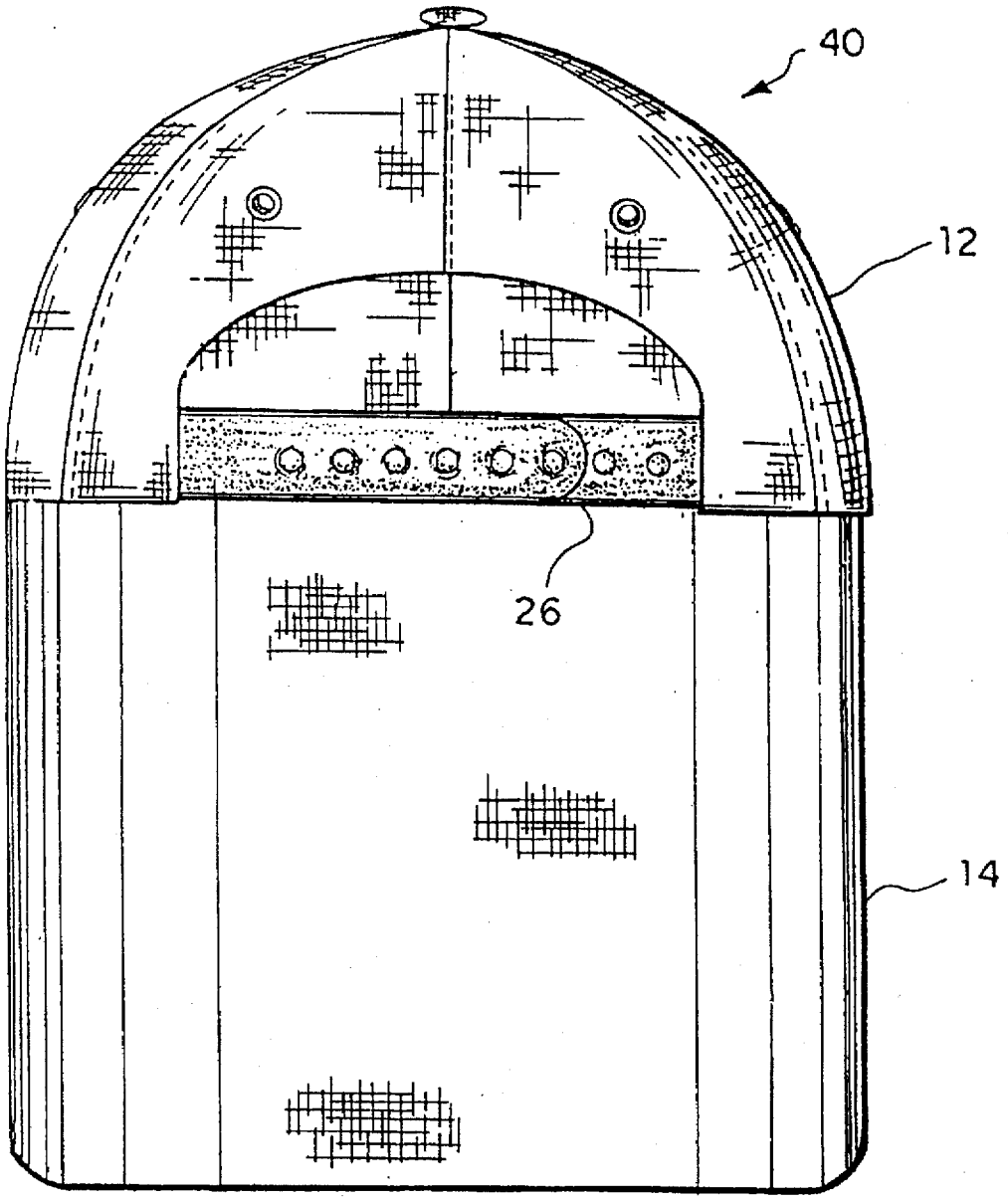
FIG. 4 is a front elevational view of the second embodiment.
Figure 5:
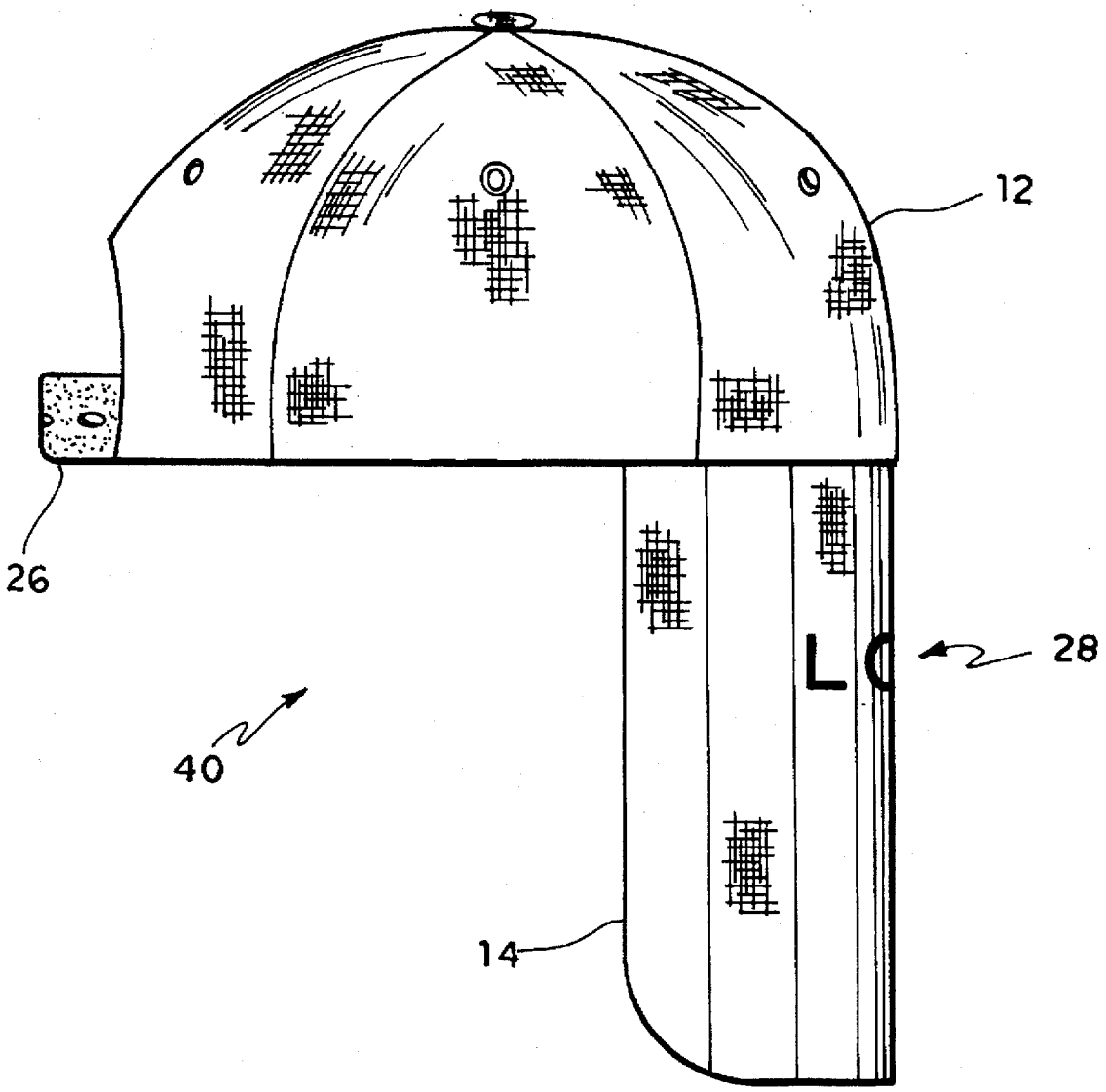
FIG. 5 is a right side elevational view of the second embodiment.

FIGS. 4 and 5 show a second embodiment of the invention wherein the adjustable brimless cap 40 includes the cloth 14 and logo 28 or similar design and cap adjustment means 26 but does not have a detachable chin strap.

Figure 6:
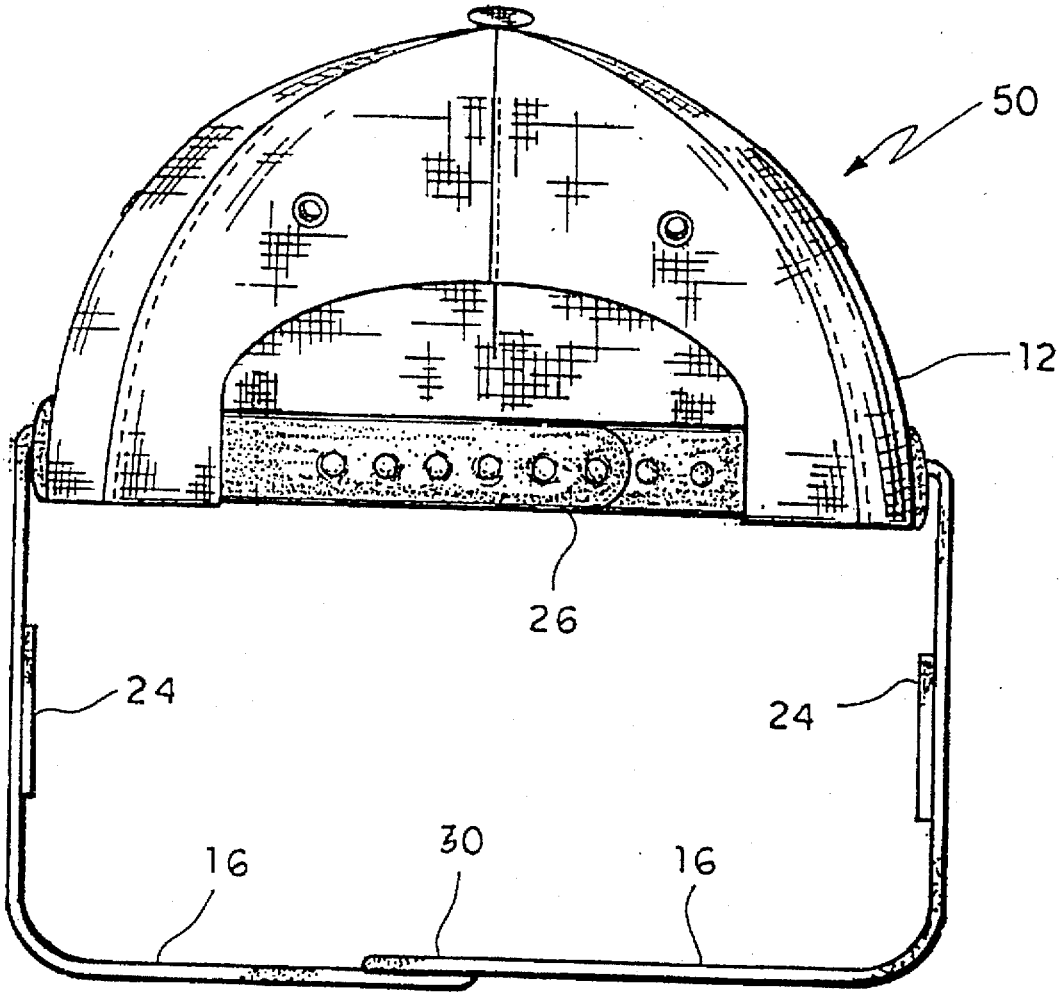
FIG. 6 is a front elevational view of the third embodiment.

FIG. 6 shows a third embodiment of the invention wherein the adjustable brimless cap 50 includes the chin strap 16 along with ear cushions 24 but does not have a cloth attached to the crown 12. The chin strap 16 is attached by attaching means 30 to secure the cap 50 to the wearer.

It is to be understood that the present invention is not limited to the embodiments described above, but encompasses any and all embodiments within the scope of the following claims.

I claim:

1. A visorless baseball-style cap comprising:

a crown portion dimensioned and configured to fit an individual's head, said crown portion having a front, rear, left side, right side, wherein said crown portion is substantially dome-shaped and includes an opening on said front;

a flexible material attached to said rear and a portion of said left side and said right side, said flexible material having indicia thereupon and extending substantially vertically from said crown portion; and means for adjusting said cap to fit different size heads wherein said means for adjusting said cap are attached to the front of said crown portion bridging said opening of said crown portion.

2. The baseball-style cap according to claim 1, wherein said flexible material is made of cloth.

3. The baseball-style cap according to claim 1, further comprising means for securing said cap to an individual's head wherein said means for securing said cap are attached to said left side and said right side of said crown portion.

4. The baseball-style cap according to claim 3, wherein said means for securing said cap includes a chin strap comprising:

a first strap attached at one end to said left side of said crown portion adjacent said opening;

a second strap attached at one end to said right side of said crown portion adjacent said opening; and means to attach said first strap to said second strap.

5. The baseball-style cap according to claim 4, wherein said means for securing said cap further comprise:

a first ear cushion and a second ear cushion dimensioned and configured to cover an individual's ears wherein said first ear cushion is attached to said first strap and said second ear cushion is attached to said second strap.

6. The baseball-style cap according to claim 5, wherein said flexible material is made of cloth.

* * * * *